US005362200A

United States Patent [19]

Ushirogata

[11] Patent Number: 5,362,200

[45] Date of Patent: Nov. 8, 1994

[54] SHEET TRANSPORTING DEVICE FOR A SORTER

[75] Inventor: Yoshiaki Ushirogata, Tokyo, Japan

[73] Assignee: Ricoh Company, Ltd., Tokyo, Japan

[21] Appl. No.: 227,993

[22] Filed: Apr. 15, 1994

Related U.S. Application Data

[63] Continuation of Ser. No. 996,139, Dec. 23, 1992, abandoned.

[30] Foreign Application Priority Data

| | | | |
|---|---|---|---|
| Dec. 26, 1991 | [JP] | Japan | 3-344191 |
| Jan. 9, 1992 | [JP] | Japan | 4-001852 |
| Oct. 12, 1992 | [JP] | Japan | 4-272585 |

[51] Int. Cl.[5] ..... B65G 57/03

[52] U.S. Cl. ..... 414/791; 270/58; 271/293; 414/790.2

[58] Field of Search ..... 414/791

[56] References Cited

U.S. PATENT DOCUMENTS

| | | | |
|---|---|---|---|
| 3,995,748 | 12/1975 | Loorey | 271/293 |
| 4,214,746 | 7/1980 | Redding et al. | 271/293 |
| 4,385,827 | 5/1983 | Naramore | 271/292 |
| 4,746,111 | 5/1988 | Naramore | 271/292 |
| 5,141,215 | 8/1992 | Ishigura et al. | 270/53 |
| 5,150,889 | 9/1992 | Taguchi | 270/53 |
| 5,201,503 | 4/1993 | Matsui et al. | 270/53 |
| 5,217,215 | 6/1993 | Ohata et al. | 270/58 |
| 5,265,855 | 11/1993 | Kimura et al. | 270/58 |

FOREIGN PATENT DOCUMENTS

| | | | |
|---|---|---|---|
| 189967 | 11/1982 | Japan | 271/292 |
| 45060 | 2/1992 | Japan | 271/292 |

*Primary Examiner*—Michael S. Huppert
*Assistant Examiner*—Gregory A. Morse
*Attorney, Agent, or Firm*—Oblon, Spivak, McClelland, Maier & Neustadt

[57] ABSTRACT

A sheet transporting device applicable to a sorter of the type having a plurality of bins arranged one above another for receiving sheets sequentially driven out of an image forming apparatus includes a top tray disposed above an uppermost one of the bins. A sheet stack is pulled out from each bin, transported upward, and then discharged onto the top tray. This not only promotes easy take-out of sheet stacks from the sorter but also allows the number of sheet stacks greater than the number of bins to be produced without interruption.

7 Claims, 5 Drawing Sheets

SHEET TRANSPORTING DEVICE FOR A SORTER

This application is a continuation of application Ser. No. 07/996,139, filed on Dec. 23, 1992, now abandoned.

BACKGROUND OF THE INVENTION

The present invention relates to a sorter for sorting sheets sequentially driven out of a copier, printer or similar image forming apparatus and, more particularly, to a sheet transporting device applicable to a sorter.

It is common for the operator of a sorter to take out sheets discharged from an image forming apparatus and stacked on bins by hand. This time- and labor-consuming. Moreover, the transfer of sheets from the image forming apparatus to the sorter cannot be resumed unless all the sheet stacks are removed from the bins, preventing the sorter from being operated without interruption. In addition, when the desired number of sheet stacks is greater than the number of bins available with the sorter, it has been customary to position two identical sorters side by side, needing a great space for installation.

SUMMARY OF THE INVENTION

It is, therefore, an object of the present invention to provide a sheet transporting device for a sorter which allows the operator to take out sheet stacks from bins surely and easily.

It is another object of the present invention to provide a sheet transporting device which allows a sorter to be continuously used without interruption.

It is another object of the present invention to provide a sheet transporting device which allows a sorter to form a greater number of sheet stacks than the number of bins available therewith continuously.

In accordance with the present invention, a sheet transporting device for a sorter having a plurality of bins arranged one above another for receiving sheets sequentially driven out of an image forming apparatus comprises a top tray disposed above uppermost on e of the bins, and a transport unit for sequentially pulling out sheet stacks received in the bins and transporting the sheet stacks upward to discharge them onto the top tray.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
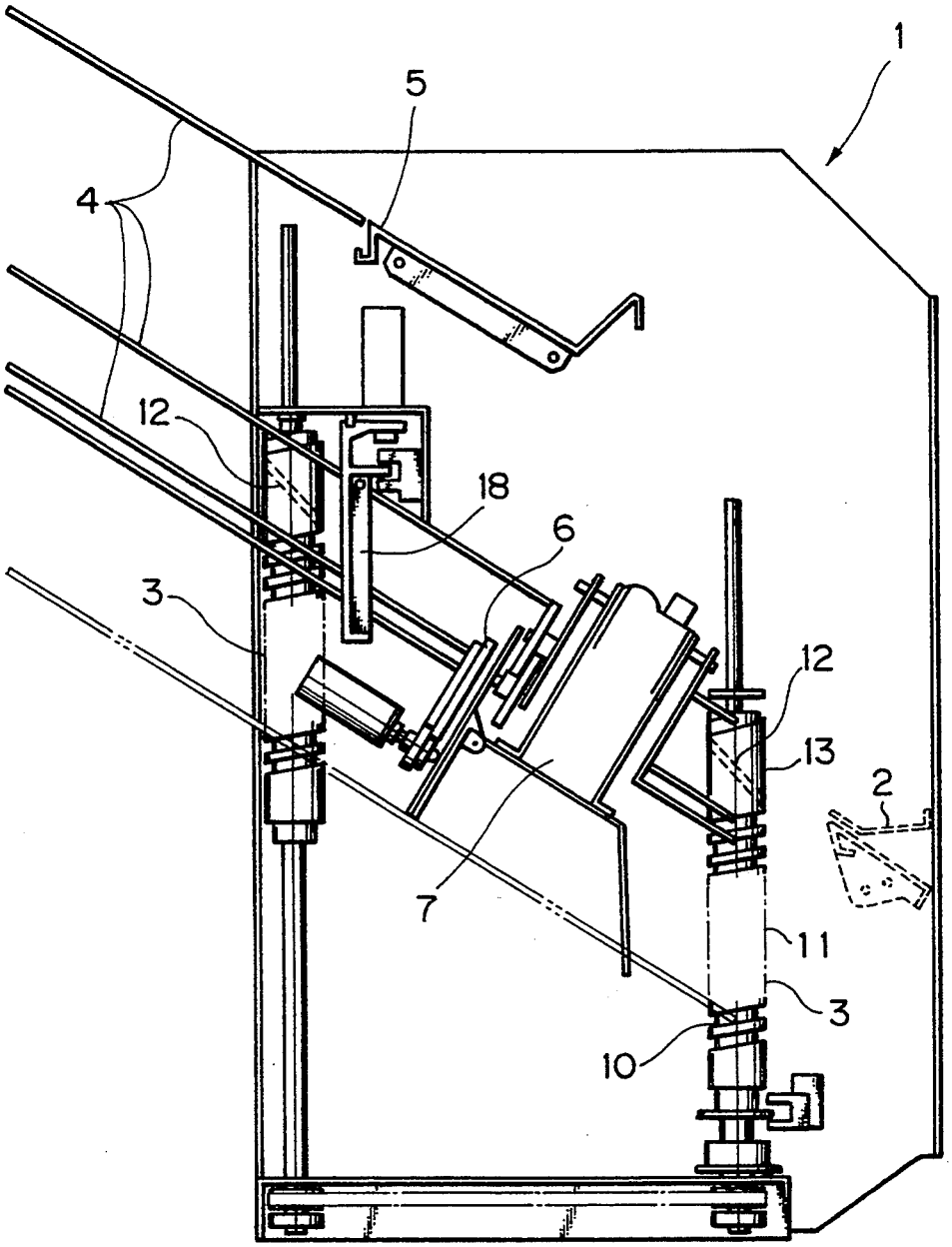
FIG. 1 is a side elevation showing a sorter to which a sheet transporting device embodying the present invention is applied.

Referring to FIGS. 1–7, a sorter to which a sheet transporting device embodying the present invention is applied is shown and generally designated by the reference numeral 1. As shown, the sorter 1 has an inlet guide to which a sheet, not shown, is handed over from a copier, printer, or similar image forming apparatus, not shown. A plurality of bins 4 are arranged one above another, and each is retained by four spiral -helical cams 3 at the corners thereof. A top tray 5 is disposed above the uppermost bin 4. Located between the inlet guide 2 and the group of bins 4 are a sheet handling device 6, a stapler 7, and a transport unit 9. The sheet handling device 6 clamps and pulls out a sheet stack received in any of the bins 4. The stapler 7 staples the sheet stack pulled out by the sheet handling device 6. The transport unit 9 delivers the sheets sequentially arrived at the inlet guide 2 to predetermined ones of the bins 4. At the same time, the transport unit 9 holds the sheet stack bound by the stapler 7, transports it upward, and then discharges it onto the top tray 5.

The four spiral-helical cams 3 each have a spiral portion 11 formed with a spiral guide groove 10 having a slow gradient, and a helical portion 13 formed with a helical guide groove 12 having a sharp gradient. The cams 3 are rotatable in the same direction at the same time as each other. The guide grooves 10 and 12 are contiguous with each other.

Figure 2:
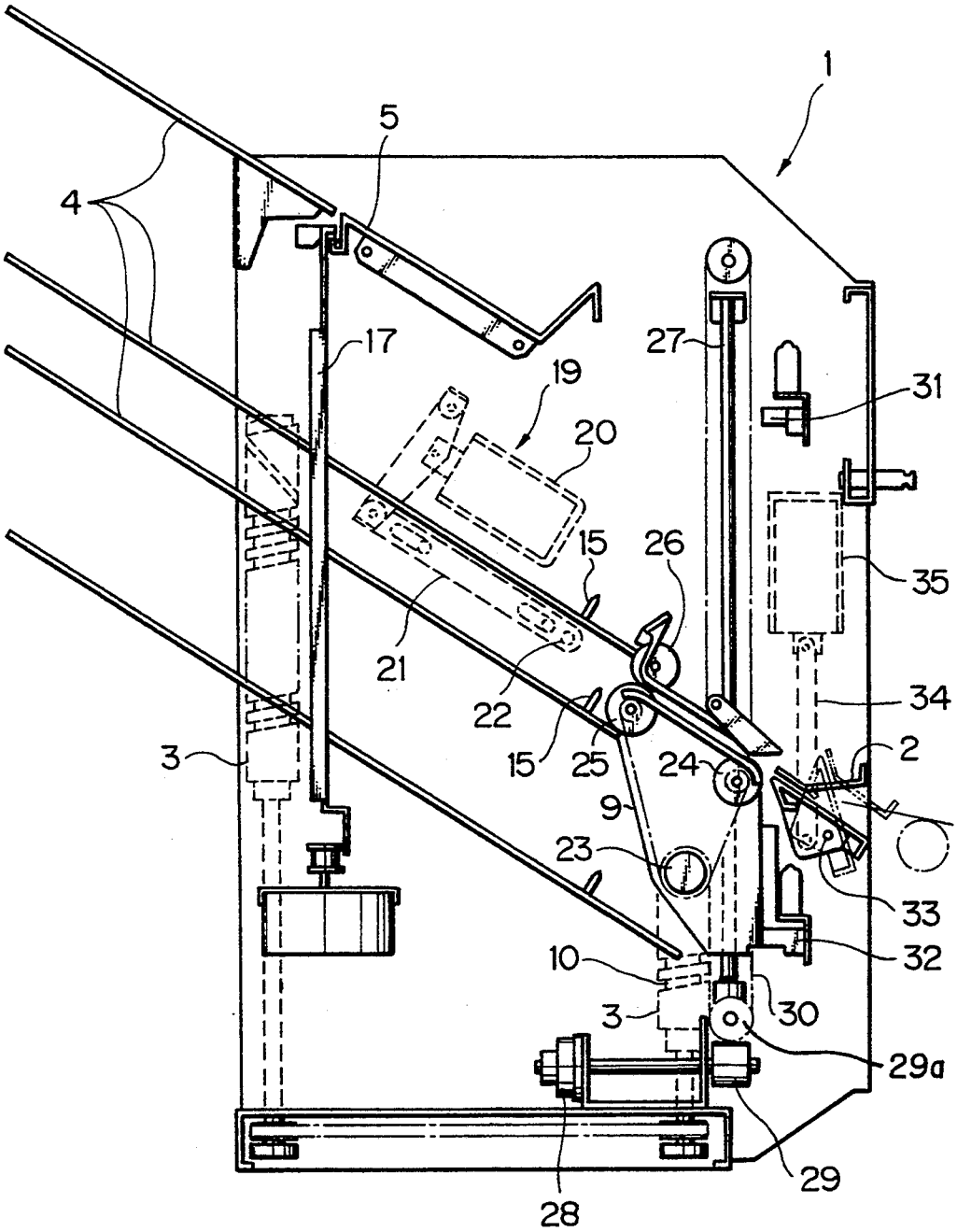
FIG. 2 is a sectional side elevation showing the sorter more specifically.
Figure 3:
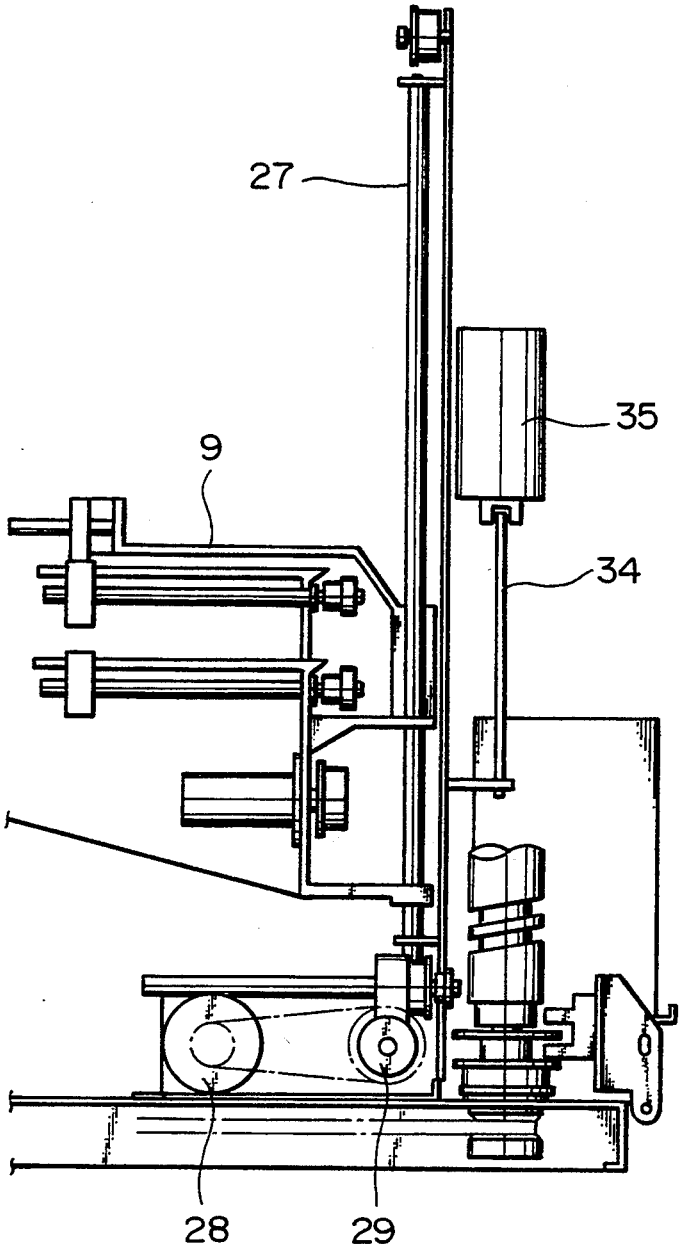
FIG. 3 is a fragmentary front view of the sorter.
Figure 7:
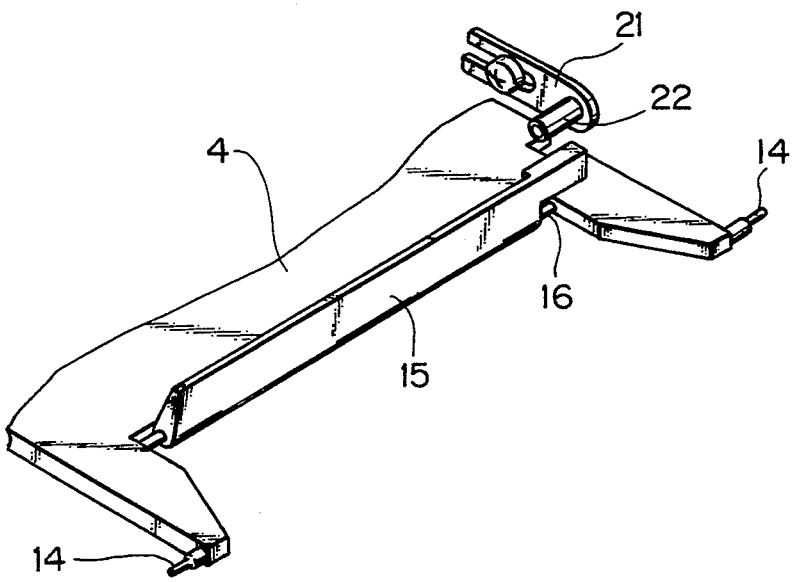
FIG. 7 is a perspective view showing how the back fence is mounted and a positional relation of a lever to the bin.

The bins 4 are inclined such that the rear ends thereof with respect to the sheet incoming direction are lower than the front ends. As shown in FIG. 7, a pin 14 is studded on each corner of each bin 4 and is received in and movable up and down along the guide grooves 10 and 12 of the associated spiral-helical cam 3 as the cam 3 is rotated. A back fence 15 is provided on the lower or rear end of each bin 4 and pivotable between an operative position where it holds the rear edge of a sheet distributed to the bin 4 and an inoperative position where it releases the sheet. The back fence 15 is constantly biased by a spring 16 toward the operative position and, in the operative position, assumes an upright position substantially perpendicular to the bin 4. In the inoperative position, the upper edge of the back fence 15 is inclined toward the transport unit 9. As shown in FIGS. 1 and 2, a jogger bar 17 and a movable side fence 18 are located to face the group of bins 4 in order to position the side edges of sheets entered the bins 4.

As shown in FIG. 2, a mechanism 19 for moving the back fence 15 to the above-mentioned inoperative position is situated at a position where the transport unit 9 pulls out a sheet stack bound by the stapler 7 (hereinafter referred to as a stack pull-out position for simplicity). The mechanism 19 has a solenoid 20, a lever 21 connected to the solenoid at one end thereof, and a pin 22 studded on the other end of the lever 21 and capable of abutting against the back fence 15. While a sorting operation is under way, the spiral-helical cams 3 make one full rotation intermittently with the result that the pins 14 received in the lower ends of the guide grooves 12 are raised to the upper ends of the grooves 12. On the other hand, when the cams 3 make half a rotation each, the pins 14 having been received in the lower ends of the guide grooves 12 are raised to substantially the intermediate between opposite ends of the grooves 12, raising the associated bin 4 to the stack pull-out position.

As shown in FIG. 2, the transport unit 9 has a motor 23, a transport roller 24 and a discharge roller 25 driven by the motor 23, and a sensor 26 located in the vicinity of the discharge roller 25 for sensing the trailing edge of a sheet or a sheet stack in transport. The transport unit 9 is supported by an upright guide shaft 27 and slidable up and down along the shaft 27. A motor 28, a worm gear 29, a gear 29*a* and a timing belt 30 coact to drive the transport unit 9 up and down. An upper limit sensor 31 and a lower limit sensor 32 adjoin the guide shaft 27 for sensing respectively the uppermost position of the transport unit 9 where it faces the top tray 5 and the lowermost position of the same.

The inlet guide 2 is rotatable about a shaft 33. A solenoid 35 is drivably connected to the inlet guide 2 via a lever 34. The inlet guide 2 is movable between a guide position (solid line, FIG. 2) close to the transport unit 9 and a non-guide position (phantom line, FIG. 2) remote from the transport unit 9. In the guide position, the inlet guide 2 hands over a sheet driven out of the image forming apparatus to the transport unit 9 while, in the non-guide position, it prevents the sheet from reaching the transport unit 9.

In operation, when sheets sequentially coming out of the image forming apparatus are to be distributed to the bins 4, the inlet guide 2 is brought to the guide position shown in FIG. 2. At the same time, the transport unit 9 is located at the lowermost position. In this condition, a sheet driven out of the image forming apparatus is handed over to the transport unit 9 by the inlet guide 2. At this instant, the motor 23 is driven in the forward direction to rotate the transport roller 24 and discharge roller 25. The rollers 24 and 25 transport the sheet to one of the bins 4 which faces the transport unit 9 and has the pins 14 thereof positioned at the lower ends of the guide grooves 12. When the sensor 26 senses the trailing edge of the sheet entered the bin 4, the jogger bar 17 is driven to move the sheet until the sheet abuts against the movable side fence 18, thereby positioning the sheet on the bin 4. As soon as the sheet is so positioned by the jogger bar 17, the four spiral-helical cams 3 make one rotation in the same direction with the result that the pins 14 of the bin 4 are raised to the upper ends of the guide grooves 12. On the other hand, the next bin 4 having the pins 14 thereof received in the guide grooves 10 which are slower in gradient than the guide grooves 12 is raised to the lower ends of the guide grooves 12. In this condition, a sheet is distributed to and positioned on this bin 4. Such a procedure is repeated to raise and lower the bins 4 intermittently the number of times corresponding to the desired number of copies. Consequently, a plurality of sheets are stacked in each of the bins 4.

As the image forming apparatus sends a signal indicative of the end of image formation to the sorter 1, the side fence 18 is brought to an inoperative position. At the same time, the sheet handling device 6 is operated to clamp and pull out the sheet stack from the bin 4 toward the stapler 7. Then, the stapler 7 binds the sheet stack. The sheet handling device 6 returns the sheet stack bound by the stapler 7 to the bin 4. At this instant, every time the sheet stack in one bin 4 is stapled, the cams 3 make one rotation to lower the bins 4 to allow the other sheet stacks to be stapled one after another.

After all the sheet stacks on the bins 4 have been stapled, the solenoid 35 is energized to move the inlet guide 2 to the non-guide position away from the transport unit 9. Also, the motor 23 of the transport unit 9 is reversed to reverse the rotation of the rollers 24 and 25. Further, the cams 3 make half a rotation to raise the pins 14 received in the lower ends of the guide grooves 12 to substantially the intermediate of the grooves 12. As a result, the bin 4 with such pins 14 is raised to the sheet pull-out position, as shown in FIGS. 4 and 5.

When one bin 4 is brought to the sheet pull-out position, the solenoid 20 is energized to move the lever 21 toward the transport unit 9. Then, the pin 22 studded on the lever 21 abuts against the back fence 15 to move it to the inoperative position, as shown in FIG. 5. Consequently, the sheet stack bound and received in the bin 4 slides down toward the transport unit 9 while being guided by the back fence 15. The rollers 25 and 24 rotating in the reverse direction drive such a sheet stack into the transport unit 9. As the sensor 26 senses the rear edge of the sheet stack entered the transport unit 9, the motor 23 is deenergized while the sheet stack is retained by the transport unit 9. Simultaneously, the solenoid 20 is deenergized to restore the back fence 15 to the operative position.

On the stop of rotation of the motor 23, the motor 28 is driven to move the transport unit 9 upward along the guide shaft 27 via the worm gear 29, gear 29*a* and timing belt 30, as shown in FIG. 2. When the sensor 31 senses the transport unit 9 at the uppermost position shown in FIG. 6, the motor 28 is turned off. Then, the motor 23 is driven in the forward direction to discharge the sheet stack from the transport unit 9 to the top tray 5. As the sensor 26 senses the rear edge of the sheet stack discharged to the top tray 5, the motor 23 is deenergized while the motor 28 is reversed to lower the transport unit 9. When the transport unit 9 reaches the rearmost position as determined by the sensor 32, the motor 28 is turned off. It is to be noted that while the transport unit 9 is raised and then lowered, the cams 3 make half a rotation to raise the pins 14 of the bin 4 underlying the bin 4 having released the sheet stack to the lower ends of the guide grooves 12.

Figure 4:
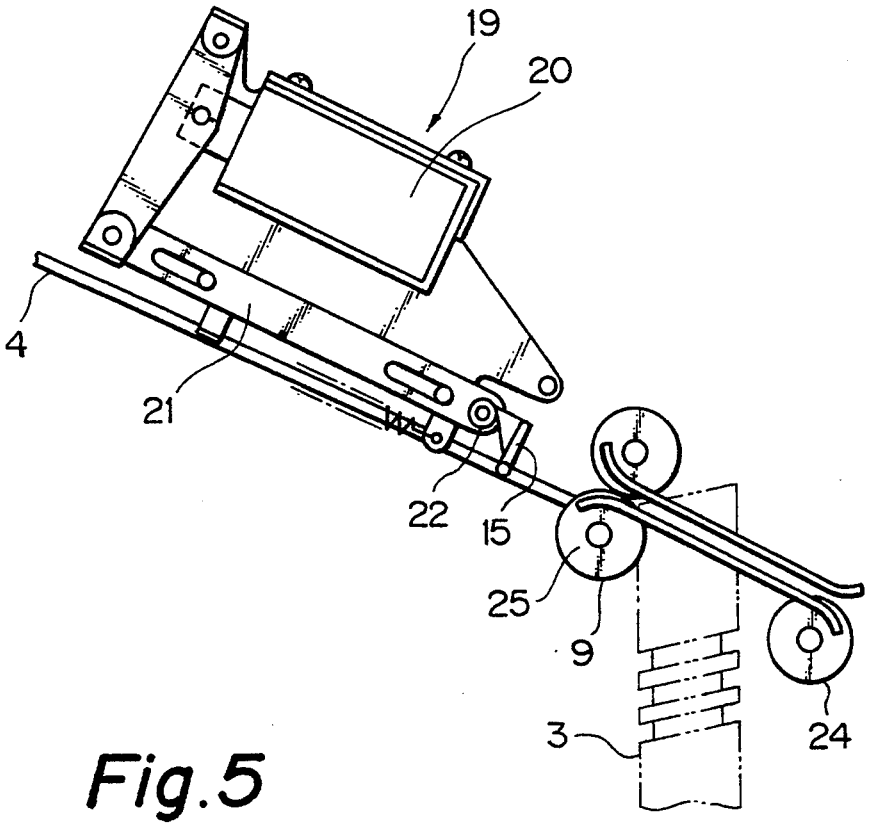
FIG. 4 is a side elevation representative of a condition wherein one bin of the sorter is raised to a stack pull-out position.
Figure 5:
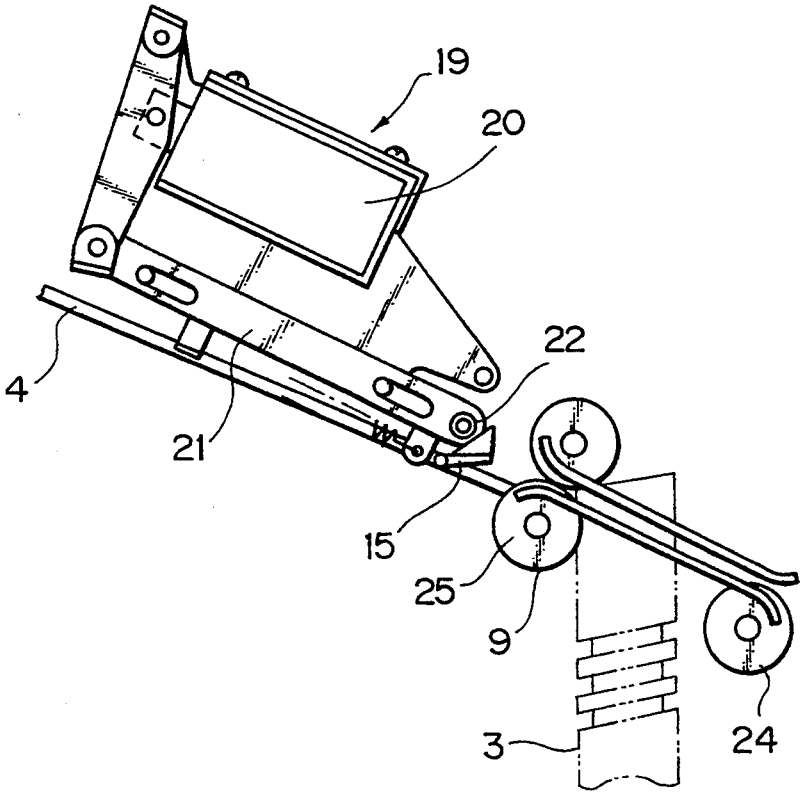
FIG. 5 is a side elevation indicative of an inoperative position of a back fence which is provided on the bin located at the stack pull-out position.
Figure 6:
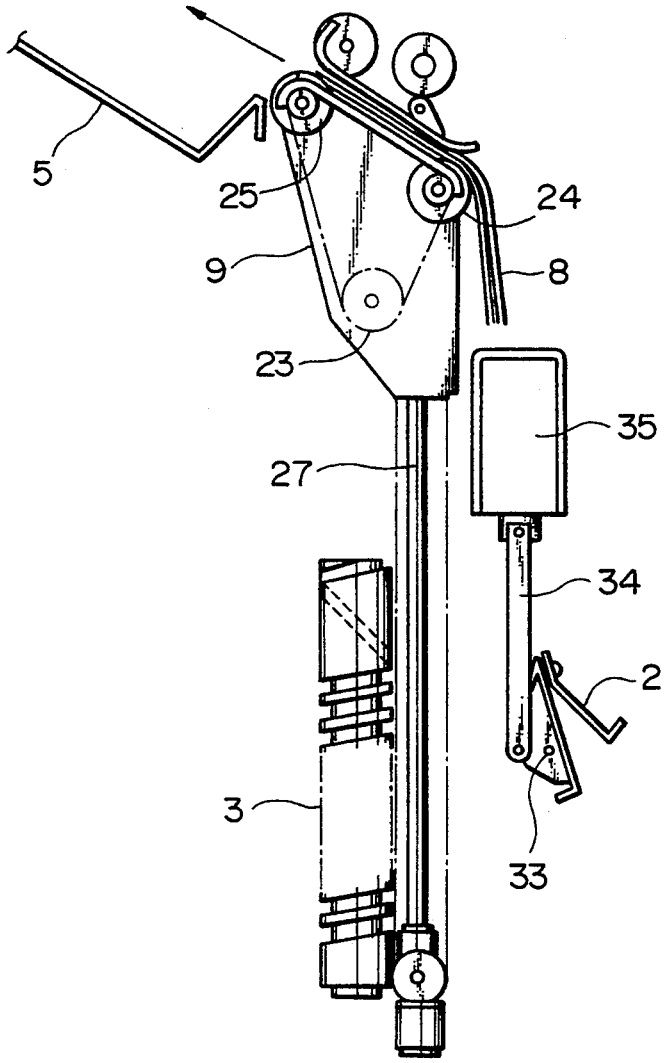
FIG. 6 is a side elevation showing a transport unit holding a sheet stack and raised to a position for discharging the sheet stack to a top tray.

After the transport unit 9 has been brought to the lowermost position, the cams 3 again make half a rotation to raise the next bin 4 to the sheet pull-out position, as shown in FIGS. 4 and 5. The sheet stack on this bin 4 is pulled out, stapled, and then discharged to the top tray 5 in the same manner as the previous sheet stack. The above operation is repeated until all the sheet stacks have been driven out to the top tray 5.

In summary, in accordance with the present invention, sheet stacks sequentially pulled out of bins and stapled are automatically discharged to a top tray. The operator, therefore, has only to take out such sheet stacks from the top tray. This is easier than taking out the sheet stacks from the respective bins. Moreover, when all the sheet stacks on the bins are driven out to the top tray by a transport unit, the bins regain the same condition as at the start of sorting operation. Hence, not only a sorter can be used continuously, but also the sorting operation can be performed without interruption even when the desired number of sheet stacks is greater than the number of the bins.

What is claimed is:

1. A sheet transporting device for a sorter having a plurality of bins arranged one above another for receiving sheets sequentially driven out of an image forming apparatus and forming said sheets into stacks, said device comprising:

a top tray disposed above an uppermost one of the bins; and an upward sheet stack discharge unit positioned between an outlet of the image forming apparatus and the bins, the upward sheet stack discharge unit being movable in an up-and-down direction for distributing sheets from the outlet to each of the bins and, on completing distribution of the sheets to the bins, substantially pulling out sheet stacks from each of the bins and then moving the sheet stacks in the up-and-down direction relative to the bins to thereby sequentially discharge the sheet stacks to the top tray.

2. A device as claimed in claim 1, further comprising a back fence provided on each of the bins and movable between an operative position for holding a rear edge of the sheet stack received in the bin with respect to a direction in which the sheet stack is introduced and an inoperative position for releasing said sheet stack.

3. A device as claimed in claim 2, further comprising a mechanism located in a conveyance path in which the sheet stack is to be pulled out toward said transport unit for moving said back fence to said inoperative position.

4. A device as claimed in claim 3, wherein in said inoperative position an upper end portion of said back fence is inclined toward said transport unit.

5. A device as claimed in claim 3, further comprising:

spiral-helical cams each being rotatable about an axis thereof and formed with a spiral guide groove; and pins studded on each of the bins and each being received in respective one of the spiral guide grooves;

said bins being movable up and down due to the rotation of said spiral-helical cams such that when said spiral-helical cams make half a rotation each, one of said bins is brought to a stop at said position where the sheet stack is to be pulled out.

6. A device as claimed in claim 1, wherein said upward sheet stack discharge unit comprises a sensor for sensing a trailing edge of a sheet or sheet stack in transport, wherein said upward sheet stack discharge unit is moved from a sheet stack pull-out position to said top tray when a trailing edge of a sheet stack which is pulled out of one of said bins by said upward sheet stack discharge unit is sensed by said sensor.

7. A device as claimed in claim 6, wherein said upward sheet discharge unit is moved from said top tray to said sheet stack pull-out position when a trailing edge of a sheet stack which is discharged from said upward sheet discharge unit to said top tray is sensed by said sensor.

* * * * *